US007140939B2

(12) United States Patent
Ikeya et al.

(10) Patent No.: US 7,140,939 B2
(45) Date of Patent: Nov. 28, 2006

(54) METHOD OF MANUFACTURING DISPLAY PANEL

(75) Inventors: Tomoyoshi Ikeya, Yamanashi-ken (JP); Tomoyuki Nakatani, Yamanashi-ken (JP); Toshiaki Yoshitani, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 287 days.

(21) Appl. No.: 10/937,875

(22) Filed: Sep. 10, 2004

(65) Prior Publication Data

US 2005/0085151 A1 Apr. 21, 2005

(30) Foreign Application Priority Data

Oct. 16, 2003 (JP) ..... 2003-356387
Jan. 14, 2004 (JP) ..... 2004-007085
May 19, 2004 (JP) ..... 2004-149521

(51) Int. Cl.
*H01J 9/00* (2006.01)

(52) U.S. Cl. ..... 445/23

(58) Field of Classification Search ..... 445/23–25
See application file for complete search history.

(56) References Cited

U.S. PATENT DOCUMENTS 3,973,815 A * 8/1976 Bode et al. ..... 445/25

FOREIGN PATENT DOCUMENTS

JP 2000-030618 1/2000

* cited by examiner

*Primary Examiner*—Joseph Williams
(74) *Attorney, Agent, or Firm*—Arent Fox PLLC

(57) ABSTRACT

A method of manufacturing a display panel in which a sealing layer is formed so as to enclose an internal space created between a pair of opposite front and back substrates, and the sealing material is heated to soften at a predetermined temperature and fuse to the substrates to seal the internal space. A primary evacuation process for evacuation of the discharge space and an introduction process for introducing replacement gas into the discharge space undergoing the primary evacuation process are performed after a temperature for heating the sealing layer reaches a starting temperature for softening the sealing layer and before the sealing process for sealing the discharge space with the sealing layer is performed.

16 Claims, 11 Drawing Sheets

TEMPERATURE CHANGE IN BAKING FURNACE H

TEMPERATURE CHANGE IN BAKING FURNACE H

SECOND EMBODIMENT

TEMPERATURE CHANGE IN BAKING FURNACE H

THIRD EMBODIMENT

TEMPERATURE CHANGE IN BAKING FURNACE H

FOURTH EMBODIMENT

TEMPERATURE CHANGE IN BAKING FURNACE H

FIFTH EMBODIMENT

TEMPERATURE CHANGE IN BAKING FURNACE H

METHOD OF MANUFACTURING DISPLAY PANEL

BACKGROUND OF THE INVENTION

1. Field of the Invention

This invention relates to a method of manufacturing a display panel.

The present application claims priority from Japanese Applications No. 2004-149521 and 2004-7085, 2003-356387, the disclosure of which is incorporated herein by reference.

2. Description of the Related Art

FIG. 1 is a vertical sectional view showing the panel structure of a reflection-type PDP (Plasma Display Panel) driven by alternating current, as an example of display panels.

The PDP includes a front substrate 1. On the inner surface of the front substrate 1 are formed row electrode pairs (X, Y) each constituted of a row electrode X and a row electrode Y paired with each other, a dielectric layer 2 covering the row electrode pairs (X, Y) and a protective layer 3 made of MgO or the like and covering the dielectric layer 2. The row electrodes X and Y of each row electrode pair (X, Y) includes transparent electrodes Xa and Ya which are made of ITO or the like, and bus electrodes Xb and Yb which are formed of thick-film electrodes made of silver or the like.

The front substrate 1 is opposite to a back substrate 4. On the inner surface of the back substrate 4 facing toward the front substrate 1, column electrodes D extend in a direction at right angles to the row electrode pairs (X, Y) and form discharge cells C within a discharge space S in positions corresponding to intersections with the row electrode pairs (X, Y). On this inner surface, further, a column-electrode protective layer 5 is formed and covers the column electrodes D. Then, phosphor layers 6 colored red, green and blue for the individual discharge cells C are formed on the column-electrode protective layer 5. Then, a partition wall construct (not shown) is formed for partitioning the discharge space S into the discharge cells C.

The discharge space S is formed between the front substrate 1 and the back substrate 4, and sealed at the peripheral end by a sealing layer 7. The discharge space S is filled as discharge gas with a mixture of 5 to 10 percent xenon Xe and neon Ne.

The phosphor layer 6 emits light by being excited by vacuum ultraviolet light (wavelength 147 nm) that is emitted from the xenon by discharge.

FIG. 2 is a flow graph illustrating the process in a conventional method of manufacturing the PDP structured as described above. FIG. 3 is a graph showing the relationship between a change in temperature in a baking furnace and time elapsing in the process in the conventional manufacturing method.

Next, the conventional manufacturing method is described with reference to FIGS. 2 and 3.

First, in step s1 for producing a front substrate in FIG. 2, the row electrodes X and Y are formed on the front substrate 1 by photolithography or the like. Then, the dielectric layer 2 is formed by screen printing techniques or the like. Then, MgO is deposited to form the protective layer 3.

On the other hand, in step s2 producing a back substrate, the column electrodes D are formed on the back substrate 4 by photolithography or the like. Then, the column-electrode protective layer 5 is formed by screen printing techniques or the like. Then, the partition wall construct is formed by sandblasting techniques or the like. After that, a phosphor paste is applied between partition walls of the partition wall construct and baked to form the phosphor layers 6.

Next, the peripheral portion of the inner surface of the back substrate 4 thus structured which will be placed opposite the front substrate 1 is coated with glass frit for sealing. Then, the back substrate 4 is temporarily burned at about 400 degree C. to form the sealing layer 7 (step s3).

Next, the front substrate 1 and the back substrate 4 with the sealing layer thus formed are placed opposite each other such that the row electrodes X and Y formed on the front substrate 1 are positioned at right angles to the column electrodes D formed on the back substrate 4 (step s4). While remaining in this position, the front substrate 1 and the back substrate 4 are placed in the baking furnace (step s5).

After that, as shown in FIG. 3, the temperature in the baking furnace is increased. When the temperature reaches a sealing temperature t1 (about 450 degree C.), the sealing temperature t1 is retained for a predetermined sealing-process period p1. During the sealing-process period p1, the sealing layer 7 formed on the back substrate 4 is fused to the front substrate 1 by the heating. As a result, the peripheral portion of the discharge space S created between the back substrate 4 and the front substrate 1 is sealed (step s6).

After the expiration of the sealing-process period p1, the temperature in the baking furnace is lowered to a predetermined temperature t2 (about 400 degree C.) lower than the sealing temperature t1, during which time the glass frit in the sealing layer 7 solidifies. Thereupon, the temperature t2 is retained for a predetermined evacuating-and-baking-process period p2.

Then in the evacuating-and-baking-process period p2, while the front substrate 1 and back substrate 4 are heated (baked) at the temperature t2, the discharge space S is evacuated so that a vacuum is produced in the discharge space S (step s7).

After the expiration of the evacuating-and-baking-process period p2, the temperature in the baking furnace is decreased to about room temperature. In this condition, the discharge gas is introduced into the discharge space Sat a predetermined pressure (400 to 600 Torr) (step s8). After completing the introduction of the discharge gas, an evacuation pipe, which has been used for gas-evacuating and introducing the discharge gas, is sealed with a burner or the like (step s9).

Then, drive pulses are applied between the paired row electrodes X and Y on the front substrate 1 to cause discharge for a predetermine time period. Due to this discharge, the protective layer 3 on the front substrate 1 is activated and discharge stabilization (i.e. aging) is performed (step s10).

Such a conventional method of manufacturing the display panel is disclosed in Japanese unexamined patent publication No. 2000-30618, for example.

In the conventional method of manufacturing the display panel as described above, during the sealing-process period p1 in the sealing step s6 in which the discharge space S is sealed by the sealing layer 7, atmosphere and an impure gas produced from the substrates by heating fill the space between the front substrate 1 and the back substrate 4. Therefore, the inner surfaces of the front and back substrates are exposed to the impure gas of $H_2O$, $CO_2$ and the like under high temperature conditions.

This is a significantly undesirable situation for the display panel under the manufacture process. A problem arising is the impairment of a process of degassing from MgO deposited for forming the protective layer 3 on the front substrate 1. Another problem arising is the deterioration of the phosphor materials forming the phosphor layer 6 on the back substrate 4.

There are some thinkable techniques that can be used to avoid producing such problems. In one technique, ample time for evacuating gases from the discharge space S in the evacuating-and-baking-process period p2 is provided in order to perform sufficient degassing from the protective layer (MgO) 3, thus allowing recovery of the deteriorating phosphor layer 6. Another one is vacuum sealing in which the discharge space S is sealed in vacuum environments.

However, providing for such a long time in the evacuating-and-baking-process period p2 to allow for sufficient gas-evacuation causes a considerable increase in the manufacturing time. Further, the vacuum sealing technique requires a large-scale apparatus. Accordingly, both the techniques become big factors that increase manufacturing costs.

SUMMARY OF THE INVENTION

One of tasks of the present invention is to solve the problems associated with the process of manufacturing the display panel as described above.

To attain the this task, the preset invention provides a method of manufacturing a display panel in which a sealing material is provided in a position enclosing an internal space created between a pair of substrates spaced opposite to each other at a required distance, and the sealing material is heated to be softened at a predetermined temperature and fused to the substrates to seal the internal space between the pair of substrates. This manufacturing method is characterized in that a primary evacuation process for evacuation of the internal space between the pair of substrates, and an introduction process for introducing replacement gas into the internal space undergoing the primary evacuation process are performed after a temperature for heating the sealing material reaches a starting temperature for softening of the sealing material, and before a sealing process for sealing the internal space between the pair of substrates with the sealing material is performed.

A best mode contemplated for carrying out the present invention is described: in a method of manufacturing a PDP in which a discharge space between opposite front and back substrates of the PDP is sealed by heating a sealing layer that is formed on the back substrate so as to enclose the discharge space and softening a sealing material of the sealing layer to fuse the sealing layer to the front substrate, a primary evacuation process for evacuation of the discharge space at a predetermined pressure, and a replacement gas introduction process for introducing replacement gas into the discharge space undergoing the primary evacuation are performed after a temperature for heating the sealing layer reaches either a starting temperature for softening the sealing material or a temperature slightly higher than and in the proximity of the starting temperature for softening, and before a sealing process for sealing the discharge space with the sealing layer is performed.

In the method of manufacturing the PDP according to the best mode, the sealing layer is formed on the back substrate opposing the front substrate at a required interval to enclose the discharge space. For example, the front substrate and the back substrate which are positioned opposite each other with the sealing layer in between are put in a baking furnace. The temperature in the baking furnace is raised. Therefore, the sealing layer is heated, and the sealing material forming the sealing layer is fused to the front substrate to enclose the discharge space.

At this point, a rise in the heating temperature in the baking furnace begins. Then, immediately after the heating temperature reaches the starting temperature for softening the sealing material or a temperature slightly higher than the starting temperature for softening, the primary evacuation of the discharge space is performed by using an evacuation pipe connected to the back substrate. Thereafter, the replacement gas is introduced in the discharge space having undergone the primary evacuation.

Various gases without $H_2O$ and $CO_2$ can be used as the replacement gas. For example, inert gas, a gas mixture of inert gas and hydrogen or oxygen gas; oxygen gas, nitrogen gas, fluorine gas, chlorine gas, a gas mixture of nitrogen gas and hydrogen or oxygen gas, a gas mixture of fluorine gas and hydrogen or oxygen gas, a gas mixture of chlorine gas and hydrogen or oxygen gas, or the like can be used.

With the method of manufacturing the PDP of the best mode, it is possible to produce the same effects as those produced when a vacuum sealing furnace is used for manufacturing the PDP accordingly, it is possible to resolve troubles associated with the conventional manufacturing method.

More specifically, in the manufacturing process for PDPs, heat is applied in order to seal the discharge space between the front substrate and the back substrate. After the temperature for heating the sealing layer reaches the starting temperature for softening the sealing layer, the primary evacuation of the discharge space and the introduction of replacement gas are carried out. Hence, before the sealing process for sealing the discharge space by use of the sealing layer, the atmosphere filling the discharge space and an impure gas produced from the substrates by the heating are removed from the discharge space. Thus, degassing from an MgO layer formed on the substrate, for example, is accelerated. Further, the inner surfaces of the substrates are prevented from being exposed to impure gas, such as $H_2O$, $CO_2$ and the like, under high temperature conditions, which in turn prevents deterioration of a phosphor layer formed on the substrate, for example. As a result, it becomes possible to significantly improve panel performance (discharge properties) of the PDP.

With the aforementioned manufacturing method, it is possible to exert the above effects without an increase in time for the process for evacuating gases from the discharge space after sealing the discharge space, and/or the use of a large-scale vacuum sealing apparatus. Furthermore, it is possible to practice the manufacturing method of the present invention in the conventional manufacturing apparatuses by making simple modifications or adaptations. As a result, there is no significant increase in manufacturing costs.

These and other objects and features of the present invention will become more apparent from the following detailed description with reference to the accompanying drawings.

DETAILED DESCRIPTION OF THE PREFERRED EMBODIMENTS

First Embodiment

Figure 4:
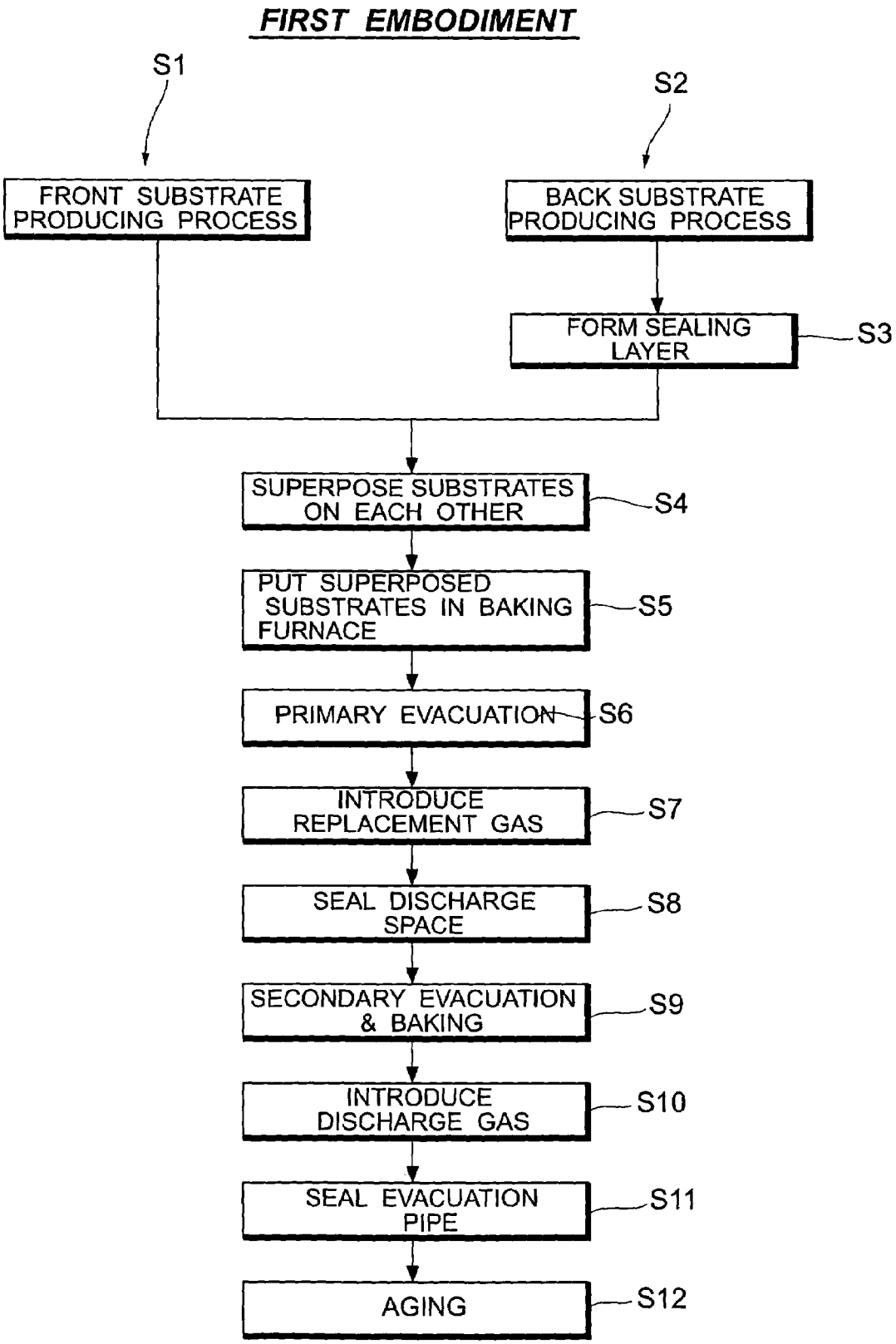
FIG. 4 is a flow graph illustrating a first embodiment of a method of manufacturing a display panel according to the present invention.
Figure 5:
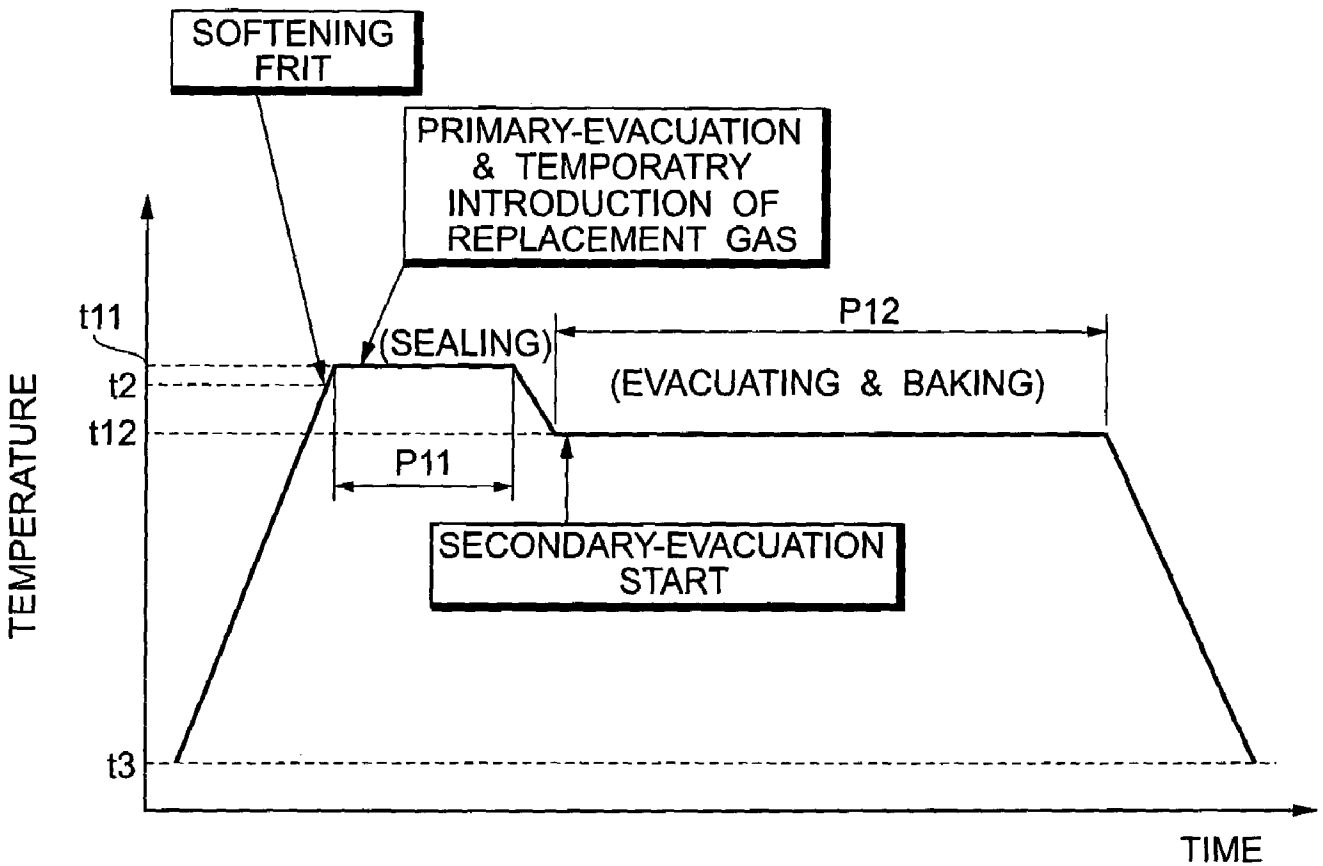
FIG. 5 is a graph showing a change in temperature in a baking furnace in the first embodiment.
Figure 6:
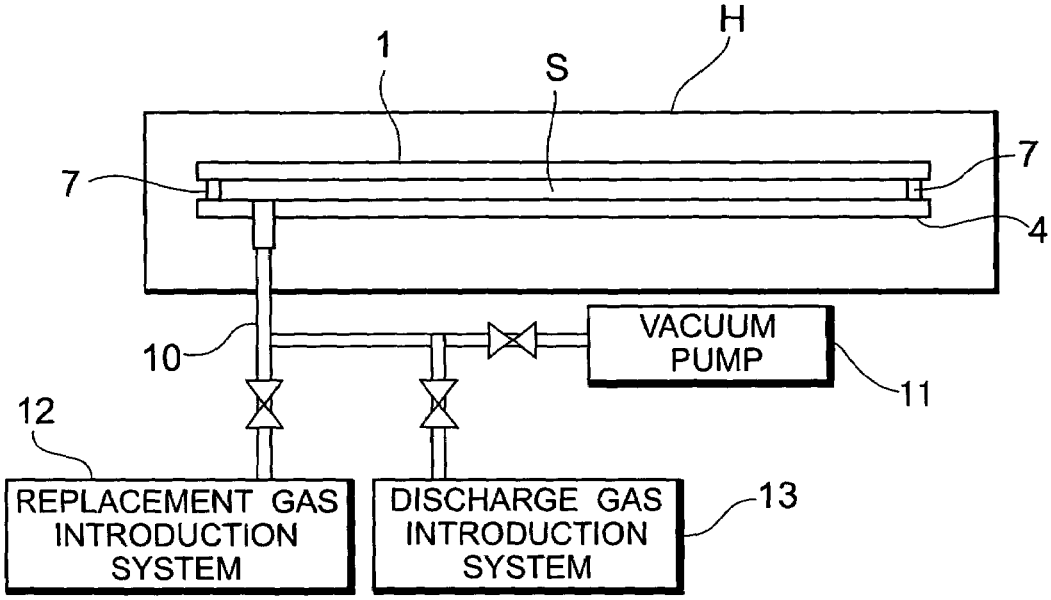
FIG. 6 is a schematic diagram of the baking furnace used in the manufacturing method in the first embodiment.

FIG. 4 is a flow graph illustrating a first embodiment of a method of manufacturing a display panel according to the present invention. FIG. 5 is a graph showing the relationship between a change in temperature in a baking furnace and the time elapsing in the process in the first embodiment. FIG. 6 is a schematic diagram of a baking furnace used in the manufacturing method in the first embodiment.

Figure 1:
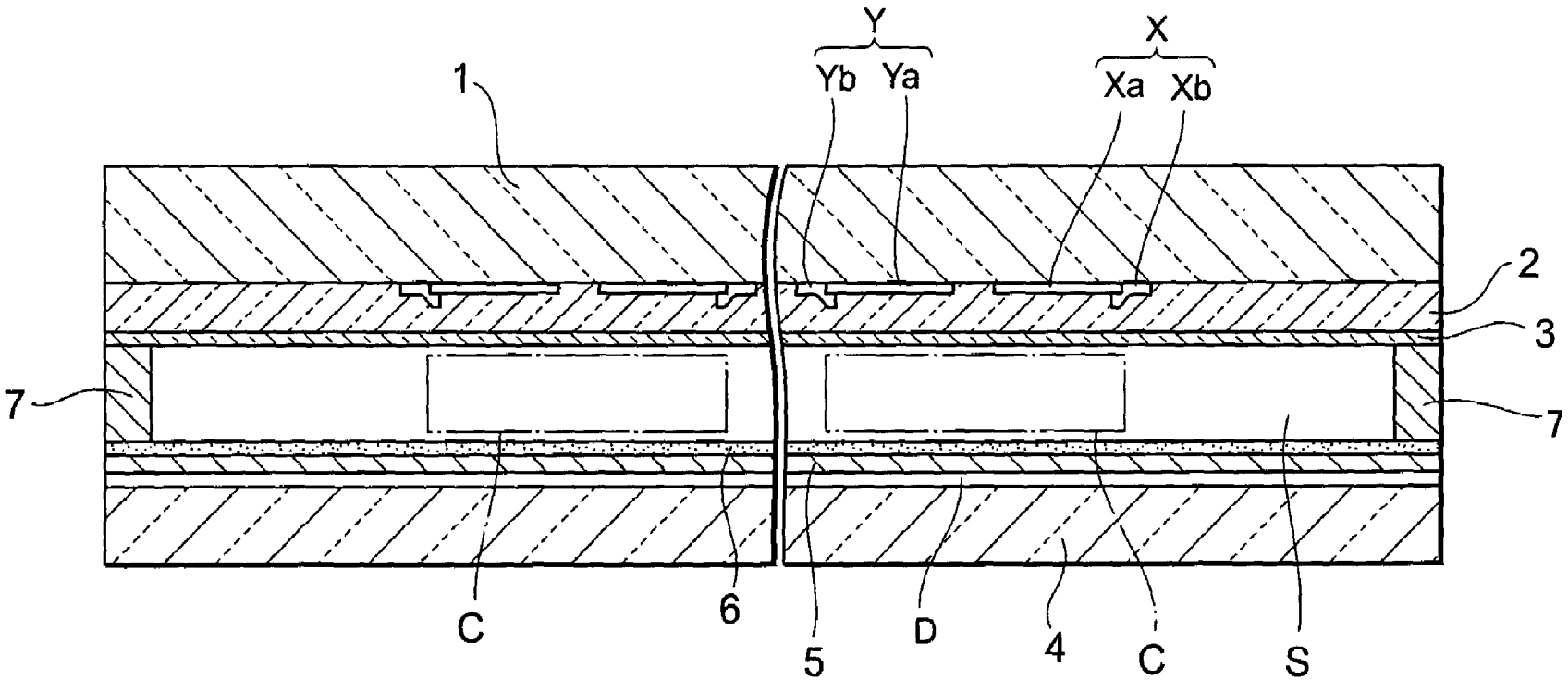
Fig. 1 RELATED ART
FIG. 1 is a sectional view illustrating a typical structure of a display panel.
Figure 2:
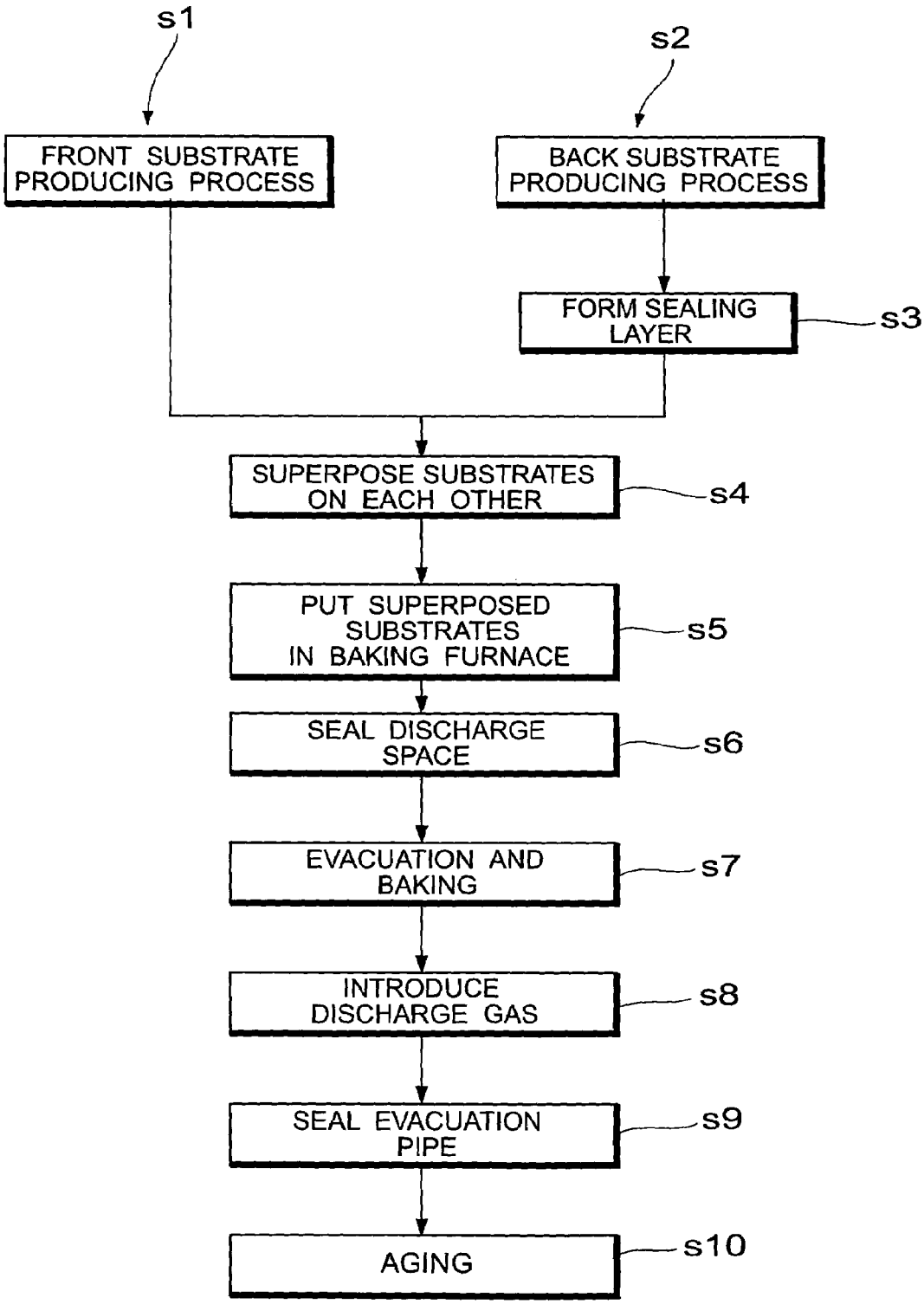
Fig.2 RELATED ART
FIG. 2 is a flow graph illustrating the process in a conventional method of manufacturing a display panel.
Figure 3:
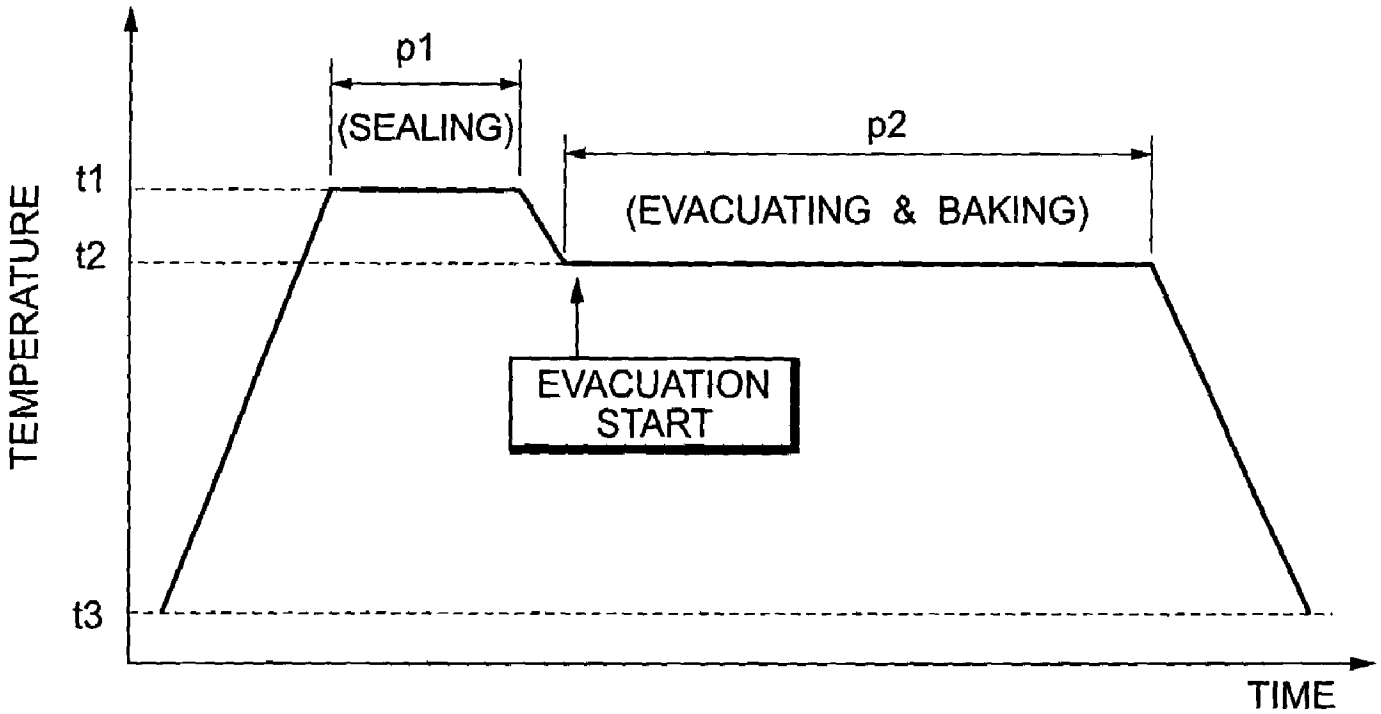
Fig.3 RELATED ART
FIG. 3 is a graph showing a change in temperature in a baking furnace in the conventional manufacturing method.

The manufacturing process in FIG. 4 is described with reference to FIG. 1.

First, the row electrode pairs (X, Y) are formed on the front substrate 1 by photolithography or the like. Then, the dielectric layer 2 is formed so as to cover the row electrode pairs (X, Y) by screen printing techniques or the like. Then, the protective layer (MgO layer) 3 is formed on the rear-facing surface of the dielectric layer 2 (Front-substrate producing step S1).

On the other hand, the column electrodes D are formed on the back substrate 4 by photolithography or the like. Then, the column-electrode protective layer 5 is formed so as to cover the column electrodes D by screen printing techniques or the like. Then, the partition wall construct for partitioning the discharge space S is formed on the column-electrode protective layer 5 by sandblasting techniques or the like. Further, a phosphor paste is applied between partition walls of the partition wall construct and baked to form the phosphor layers 6 (Back-substrate producing step S2).

After the completion of the front-substrate producing step S1 and back-substrate producing step S2 in this manner, the peripheral portion of the inner surface of the back substrate 4 which will be placed facing toward the front substrate 1 is coated with glass frit for sealing. Then, the back substrate 4 is burned at about 400 degree C. to form the sealing layer 7 (step S3).

Next, the front substrate 1 and the back substrate 4 are placed opposite each other such that the row electrodes X and Y formed on the front substrate 1 are positioned at right angles to the column electrodes D formed on the back substrate 4 (step S4). While remaining in this position, the front substrate 1 and the back substrate 4 are placed in a baking furnace H as shown in FIG. 6, and an evacuation pipe 10 is attached and sealed to an exhaust hole formed in the back substrate 4 (step S5).

The evacuation pipe 10 is connected to a vacuum pump 11, a replacement gas introduction system 12, and a discharge gas introduction system 13.

In this condition, heating in the baking furnace H is started. As shown in FIG. 5, the temperature in the baking furnace H reaches a temperature t11 (about 425 degree C.) slightly exceeding a temperature t2 (about 420 degree C.) at which the glass frit of the sealing layer 7 formed on the back substrate 4 starts melting. From this point, throughout a predetermined sealing-process period P11, the temperature in the baking furnace H is retained at the temperature t11.

Immediately after starting of the sealing-process period P11, the vacuum pump 11 is actuated to start a primary evacuation of the discharge space S created between the front substrate 1 and the back substrate 4 (step S6).

At this point, the glass frit of the sealing layer 7 is in a state in which its surface starts melting, but its fluidity is still low although the discharge space S is hermetically sealed. Accordingly, even when the primary evacuation is performed in step S6, the sealing layer 7 will not be pulled inward the discharge space S by negative pressure developed in the discharge space S.

After the primary evacuation, replacement gas is introduced from the replacement gas introduction system 12 through the evacuation pipe 10 into the discharge space S (step S7).

Various gases without $H_2O$ and $CO_2$ can be used as the replacement gas introduced in step S7. For example, inert gas, a mixture of inert gas and hydrogen or oxygen gas, oxygen gas, nitrogen gas, fluorine gas, chlorine gas, a mixture of nitrogen gas and hydrogen or oxygen gas, a mixture of fluorine gas and hydrogen or oxygen gas, a mixture of chlorine gas and hydrogen or oxygen gas, or the like can be used.

In this connection, if a slight amount of hydrogen gas (about 3% or less) is mixed into inert gas, it becomes possible to produce an effect on the recovery of the phosphor layer 6. If a slight amount of oxygen gas (about 20% or less) is mixed into inert gas, it becomes possible to produce an effect of improving film quality of the protective layer (MgO layer) 3.

Pressure at which the replacement gas is introduced in step S7 is determined in a range between about 1/100 atm and about 1 atm, for example.

During the sealing process period P11, the surface of the glass frit of the sealing layer 7 is molten by heating to be fused to the front substrate 1, thereby sealing the periphery of the discharge space S created between the back substrate 4 and the front substrate 1 (step S8).

After the expiration of the sealing-process period P11, the temperature in the baking furnace H is lowered from the temperature t11 to a temperature t12 (about 400 degree C.) that is equal to or lower than a melting temperature t2 (about 420 degree C.) of the glass frit of the sealing layer 7. Then, the temperature t12 is retained for a predetermined evacuating-and-baking-process period P12.

Then, in the evacuating-and-baking-process period P12, while the front substrate land back substrate 4 are heated (baked) at the temperature t12, a secondary evacuation is performed for exhausting gas from the discharge space S to produce a vacuum in the discharge space S (step S9).

After the expiration of the evacuating-and-baking-process period P12, the temperature in the baking furnace H is further decreased to about room temperature t3. Thereupon, the discharge gas is introduced into the discharge space S at a predetermined pressure (400 to 600 Torr) (step S10). After completing the introduction of the discharge gas, the evacuation pipe, which has been used for evacuating and introducing the discharge gas, is sealed with a burner or the like (step S11).

Then, drive pulses are applied between the paired row electrodes X and Y on the front substrate 1 to cause discharge for a predetermined time period. Due to this discharge, the protective layer 3 on the front substrate 1 is activated and discharge stabilization (i.e. aging) is achieved (step S12).

The method of manufacturing the display panel as described above is capable of producing the same effects as those produced when a vacuum sealing furnace is used for manufacturing a display panel. Accordingly, it is possible to eliminate troubles in the conventional manufacturing method.

More specifically, in the manufacturing process, after the initiation of the heating, during the sealing process period P11, the inside of the baking furnace H is held at the temperature t11 (about 425 degree C.) slightly exceeding the temperature t2 (about 420 degree C.) at which the glass frit of the sealing layer 7 start to melt. In this sealing process period P11, the primary evacuation process S6 and the replacement gas introduction process S7 are carried out before the completion of the sealing process S8 for sealing the discharge space S. Hence, the atmosphere filling the discharge space S and an impure gas produced from the substrates by the heating are removed from the discharge space S. Thus, degassing from the protective layer (MgO layer) 3 is accelerated. Further, the inner surfaces of the substrates are prevented from being exposed to the impure gas, such as $H_2O$, $CO_2$ and the like, under high temperature conditions, which in turn prevents deterioration of the phosphor layer 6. As a result, it becomes possible to significantly improve panel performance (discharge properties) of the display panel.

In the aforementioned manufacturing method, it is possible to exert the above effects without an increase in time for the evacuating-and-baking-process period P12, and/or the use of a large-scale vacuum sealing apparatus. Furthermore, it is possible to practice the manufacturing method of the present invention in the conventional manufacturing apparatus by making simple modifications or adaptations. As a result, there is no significant increase in manufacturing costs.

Further, if the pressure of the replacement gas introduced into the discharge space S is adjusted after the primary evacuation, a desired pressure in the discharge space S in the manufacturing process can be retained. This makes it possible to adjust the interval between the front substrate 1 and the back substrate 4 as required.

Note that, for the primary evacuation in the primary evacuation process S6, or for removal of the replacement gas in the secondary evacuating-baking process S9, the vacuum pump 11 is driven in advance to produce a vacuum in the evacuation pipe 10, and then a valve connecting the vacuum pump 11 and the evacuation pipe 10 is released at the time of commencing process S6 or process S9. If such steps are applied, evacuation is achieved at once in each process, thereby making reduced time in each process possible.

Figure 7:
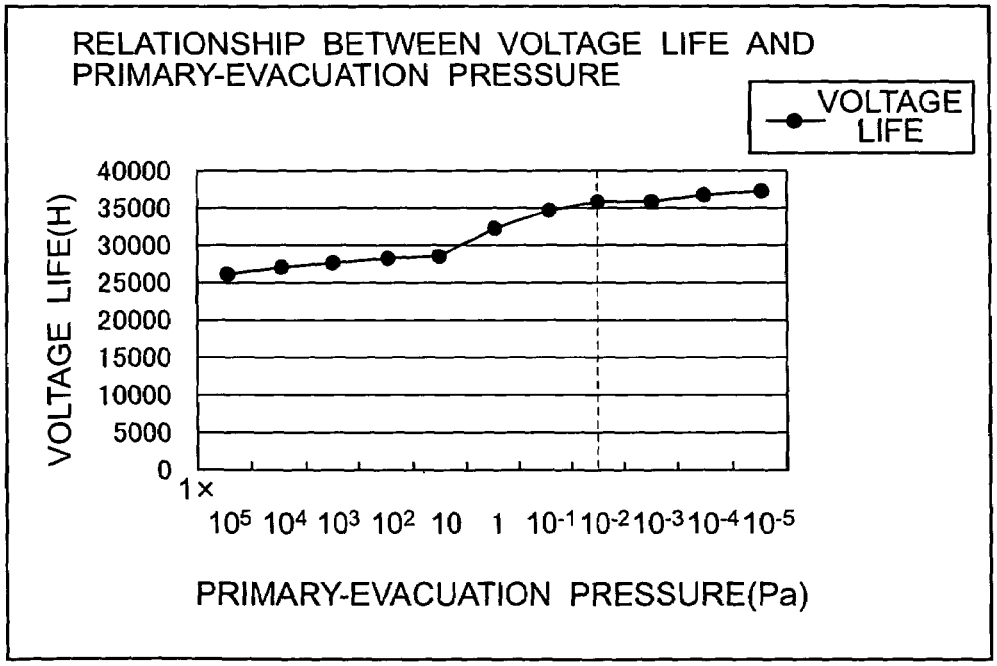
FIG. 7 is a graph showing the relationship between a primary evacuation pressure and voltage life of a PDP in the method of manufacturing the display panel according to present invention.

FIG. 7 is a graph showing the relationship between evacuation pressure in the primary evacuation process S6 and voltage life of the PDP.

As shown in FIG. 7, in the primary evacuation process S6, the lower the primary evacuation pressure, the longer the voltage life of the PDP. In particular, by setting the primary evacuation pressure at $1\times10^{-2}$ Pa or less, a significant increase in the voltage life of the PDP becomes possible.

Figure 8:
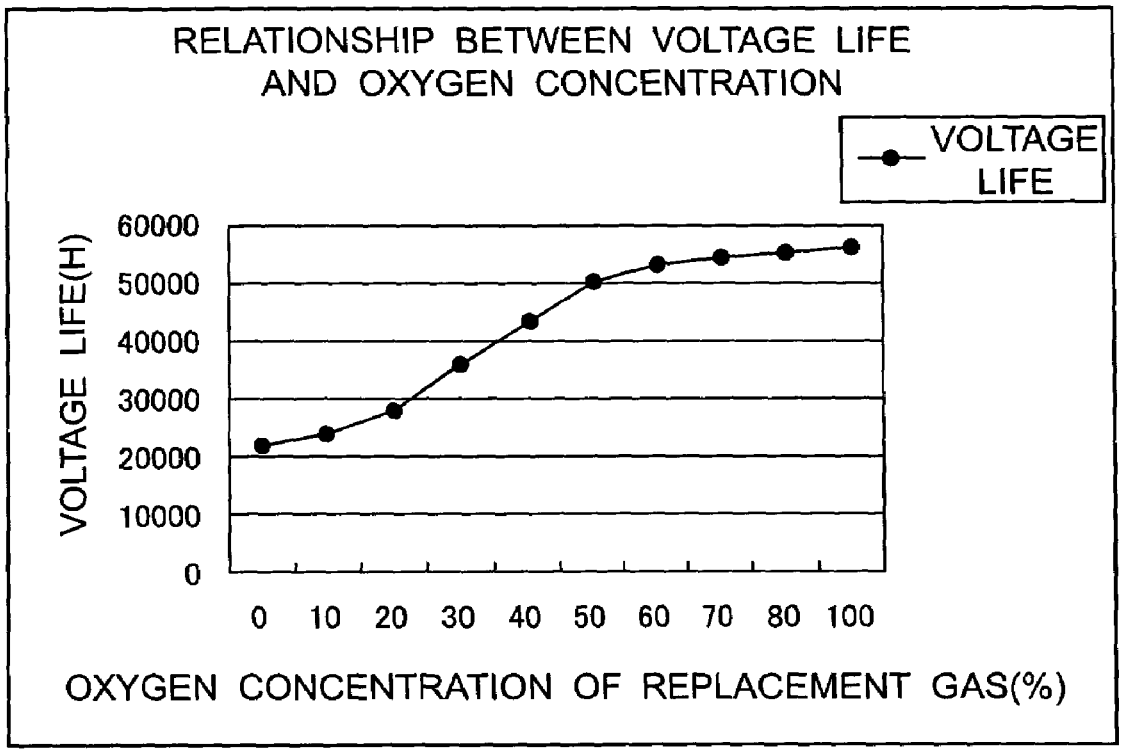
FIG. 8 is a graph showing the relationship between the concentration of oxygen gas introduced as replacement gas and voltage life of the PDP in the method of manufacturing the display panel according to the present invention.

FIG. 8 shows the relationship between the concentration of oxygen gas introduced and the accelerating-voltage life of the PDP when the oxygen gas is introduced as replacement gas in the replacement gas introduction process S7.

As shown in FIG. 8, in the replacement gas introduction process S7, the higher the concentration of oxygen gas introduced as replacement gas, the longer the voltage life of the PDP. The use of oxygen gas alone (100% concentration) as replacement gas makes it possible to maximize the voltage life for the PDP.

In this connection, if an $O_2$ mixing ratio is increased, the accelerating-voltage life of the panel is also increased. However, in this case, the initial properties of the panel may possibly become worse.

Therefore, to strike a balance between the accelerating-voltage life and the initial properties of the panel, for example, a gas mixture of $N_2$ and 35% or less $O_2$, preferably, 30% or less $O_2$, is used desirably as the replacement gas.

Second Embodiment

Figure 9:
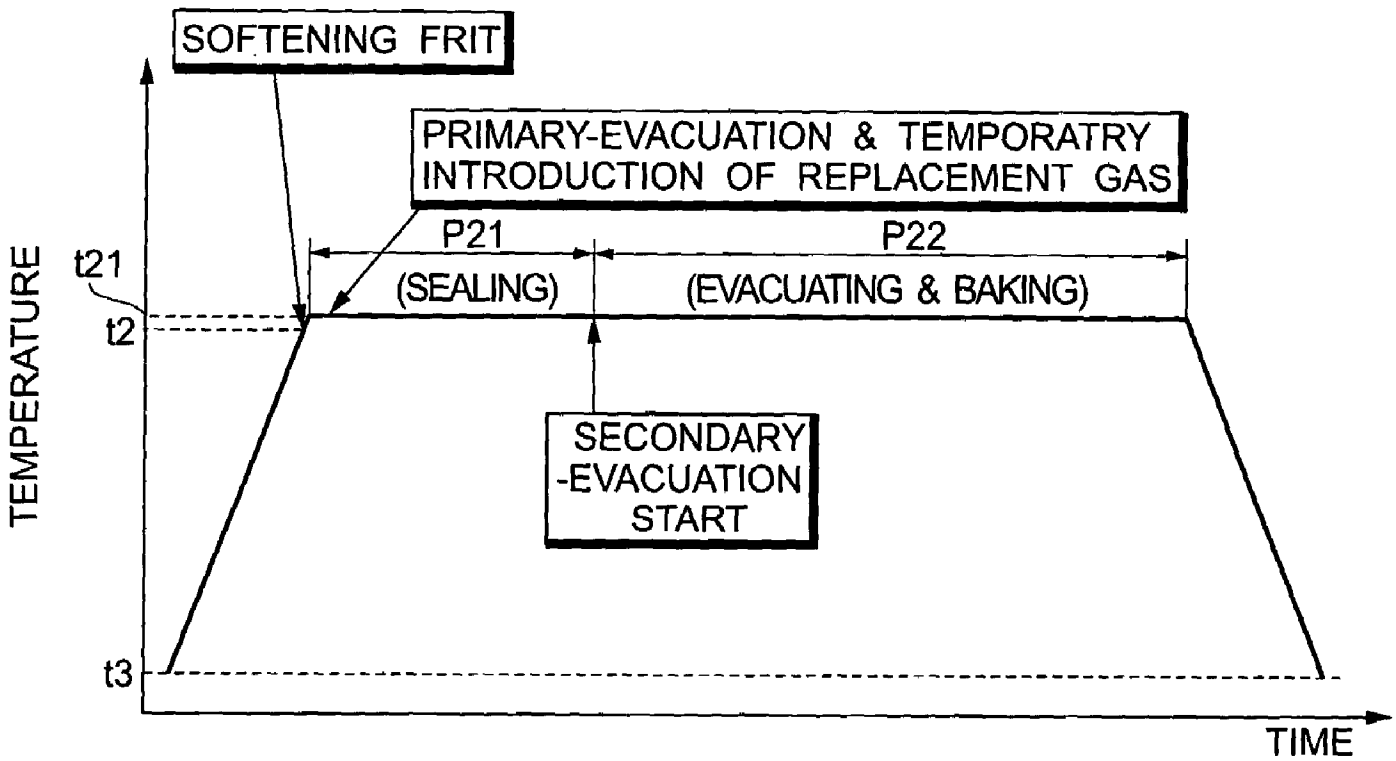
FIG. 9 is a graph illustrating a second embodiment of a method of manufacturing a display panel according to the present invention.

FIG. 9 is a graph showing the relationship between a change in temperature in the baking furnace and time elapsing in the process in a second embodiment of a method of manufacturing a display panel according to the present invention.

In the manufacturing method of the first embodiment, the set temperature t12 of the baking furnace in the evacuating-and-baking-process period P12 is set lower than the set temperature t11 in the sealing-process period P11. However, in the method of manufacturing the display panel of the second embodiment, the set temperature of the baking furnace H in both a sealing-process period P21 and an evacuating-and-baking process period P22 is retained at a temperature t21 (about 425 degree C.) slightly exceeding a temperature t2 (about 420 degree C.) at which the glass frit of the sealing layer 7 starts melting.

Specifically, the front substrate 1 and back substrate 4 which over lay each other are placed in the baking furnace H. Then, heating of the baking furnace H is started. The temperature in the baking furnace H reaches the temperature t21 (about 425 degree C.) slightly exceeding the temperature t2 (about 420 degree C.) at which the glass frit of the sealing layer 7 formed on the back substrate 4 starts to soften. Form this point, during a predetermined sealing-process period P21 and a predetermined evacuating-and-baking process period P22 subsequent to the sealing-process period P21, the temperature t21 is retained in the baking furnace H.

Just after the commencement of sealing-process period P21, the primary evacuation process S6 for driving the vacuum pump 11 to evacuate the discharge space S is performed, and then the replacement gas introduction process S7 for introducing replacement gas from the replacement gas introducing system 12, and the sealing process S8 are performed (see FIGS. 4 and 6).

After the completion of sealing-process period p21, while the inside of the baking furnace H is held at the temperature t21, the secondary evacuating-and-baking process S9 is performed in the subsequent evacuating-and-baking process period P22.

Further, after the completion of the evacuating-and-baking process period P22, the temperature in the baking furnace H is lowered to near room temperature t3. After that, the discharge gas introduction process S10 is performed to introduce discharge gas from the discharge gas introduction system 13 into the discharge space S. Then, the exhaust pipe sealing process S11 and the aging process S12 are performed.

Regarding the kinds of replacement gas introduced in the replacement gas introduction process, and the relationship between the concentration of the replacement gas and accelerating-voltage life of the PDP when oxygen gas is used as the replacement gas (FIG. 8), the second embodiment is the same as in the first embodiment.

Further, the relationship between the evacuation pressure in the primary evacuation process and voltage life of the PDP (FIG. 7) in the second embodiment is the same as that in the first embodiment.

With the method of manufacturing the PDP according to the second embodiment, as in the case of the first embodiment, in the manufacturing process for the display panel, the temperature in the baking furnace H is held in the sealing-process period P21 at the temperature t21 (about 425 degree C.) slightly exceeding the temperature t2 (about 420 degree C.) at which the glass frit of the sealing layer 7 is softened. In this sealing-process period P21, before the completion of the sealing process S8 for sealing the discharge space S, the primary evacuation process S6 and the replacement gas introduction process S7 are performed. As a result of this procedure, the atmosphere filling the discharge space S and an impure gas produced from the substrates by heating are removed from the discharge space S. Thus, degassing from the protective layer (MgO layer) 3 is accelerated. Further, the inner surfaces of the substrates are prevented from being exposed to the impure gas, such as $H_2O$, $CO_2$ and the like, under high temperature conditions, which in turn prevents deterioration of the phosphor layer 6. As a result, it becomes possible to significantly improve panel performance (discharge properties) of the display panel.

In the second embodiment, the temperature t21 in the baking furnace H, which is retained in the sealing-process period P21 and the evacuating-and-baking-process period P22, is set equal to or slightly higher than a softening point temperature for glass frit of the sealing layer 7 of the PDP. However, if the sealing layer 7 is formed of crystalline frit, the temperature t21 can be set higher than that in the case of using non-crystalline frit.

Third Embodiment

Figure 10:
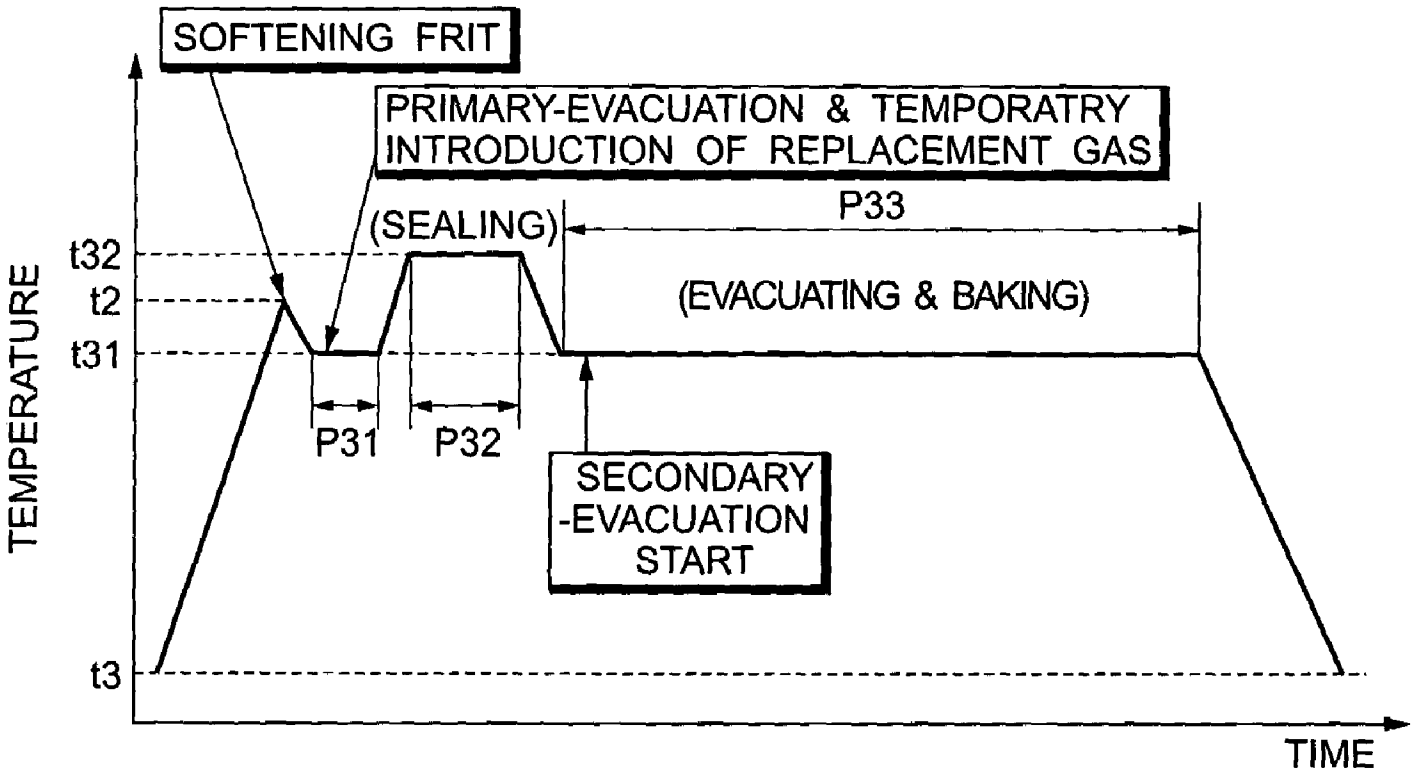
FIG. 10 is a graph illustrating a third embodiment of a method of manufacturing a display panel according to the present invention.

FIG. 10 is a graph showing the relationship between a change in temperature in the baking furnace and the time elapsing in the process in a third embodiment of a method of manufacturing a display panel according to the present invention.

In the aforementioned first and second embodiments, the heating temperature is held, during the sealing process period, at a temperature at which the sealing material starts softening. However, in the method of manufacturing the display panel in the third embodiment, the temperature in the baking furnace H, in which the front substrate 1 and the back substrate 4 overlaying each other are placed, reaches the temperature t2 of frit softening point, and then is temporarily lowered to a temperature t31 (about 400 degree C.) lower than the temperature t2 of frit softening point. Then, the temperature t31 is held during a predetermined primary evacuation-replacement gas introduction period P31.

During the primary evacuation-replacement gas introduction period P31, the primary evacuation process S6 for driving the vacuum pump 11 to evacuate the discharge space S and the replacement gas introduction process S7 for introducing the replacement gas from the replacement gas introduction system 12 are performed (see FIGS. 4 and 6).

At this point, the temperature in the baking furnace H has reached the frit softening point temperature t2 before the primary evacuation process S6 and the replacement gas introduction process S7 are performed. Therefore, the softening surface of the sealing layer 7 comes in absolute contact with the front substrate 1 to hermetically seal the discharge space S between the front substrate 1 and the back substrate 4. Accordingly, without atmosphere entering the discharge space S, the primary evacuation and the introduction of replacement gas are reliably performed.

After the completion of the primary evacuation-replacement gas introduction period P31, the temperature of the baking furnace H is raised to a sealing temperature t32 (about 450 degree C.) higher than the frit softening point temperature t2. The sealing temperature t32 is retained during a predetermined sealing process period P32. The sealing process S8 is performed in the sealing process period P32, so that the sealing layer 7 is completely hermetically attached to the front substrate 1.

After the completion of the sealing-process period P32, the temperature in the baking furnace H is lowered once again to the temperature t31. The temperature 31 is retained during an evacuating-and-baking process period P33 in which the secondary evacuating-and-baking process S9 is performed.

In the primary evacuation-replacement gas introduction period P31 and the evacuating-and-baking process period P33, the furnace temperature is required to be equal to or lower than the frit softening point, and need not be equal to it.

Further, after the completion of the evacuating-and-baking process period P33, the temperature in the baking furnace H is lowered to about room temperature t3. Then, the discharge gas introduction process S10 is performed to introduce discharge gas from the discharge gas introduction system 13 into the discharge space S. Then, the sealing process S11 for sealing the discharge space S and the aging process S12 are performed.

Regarding the kinds of replacement gas introduced in the replacement gas introduction process, and the relationship between the concentration of the replacement gas and accelerating-voltage life of the PDP when oxygen gas is used as the replacement gas (FIG. 8), the third embodiment is the same as in the first embodiment.

Further, the relationship between the evacuation pressure in the primary evacuation process and voltage life of the PDP (FIG. 7) in the third embodiment is the same as that in the first embodiment.

With the method of manufacturing the PDP according to the third embodiment, prior to the sealing process S8 in the sealing-process period P32, the primary evacuation process S6 and the replacement gas introduction process S7 are performed. As a result of this procedure, the atmosphere filling the discharge space S and impure gas produced from the substrates by heating are removed from the discharge space S. Thus, degassing from the protective layer (MgO layer) 3 is accelerated. Further, the inner surfaces of the substrates are prevented from being exposed to the impure gas, such as $H_2O$, $CO_2$ and the like, under high temperature conditions, which in turn prevents deterioration of the phosphor layer 6. As a result, it becomes possible to significantly improve panel performance (discharge properties) of the display panel.

In the third embodiment, when the temperature in the baking furnace H reaches the frit softening point temperature t2, the discharge space S between the front substrate 1 and the back substrate 4 is hermetically sealed. After that, the temperature in the baking furnace H is lowered. As a result, the flowing of the frit of the sealing layer 7 is inhibited, leading to a stable primary evacuation and stable introduction of the replacement gas.

Fourth Embodiment

Figure 11:
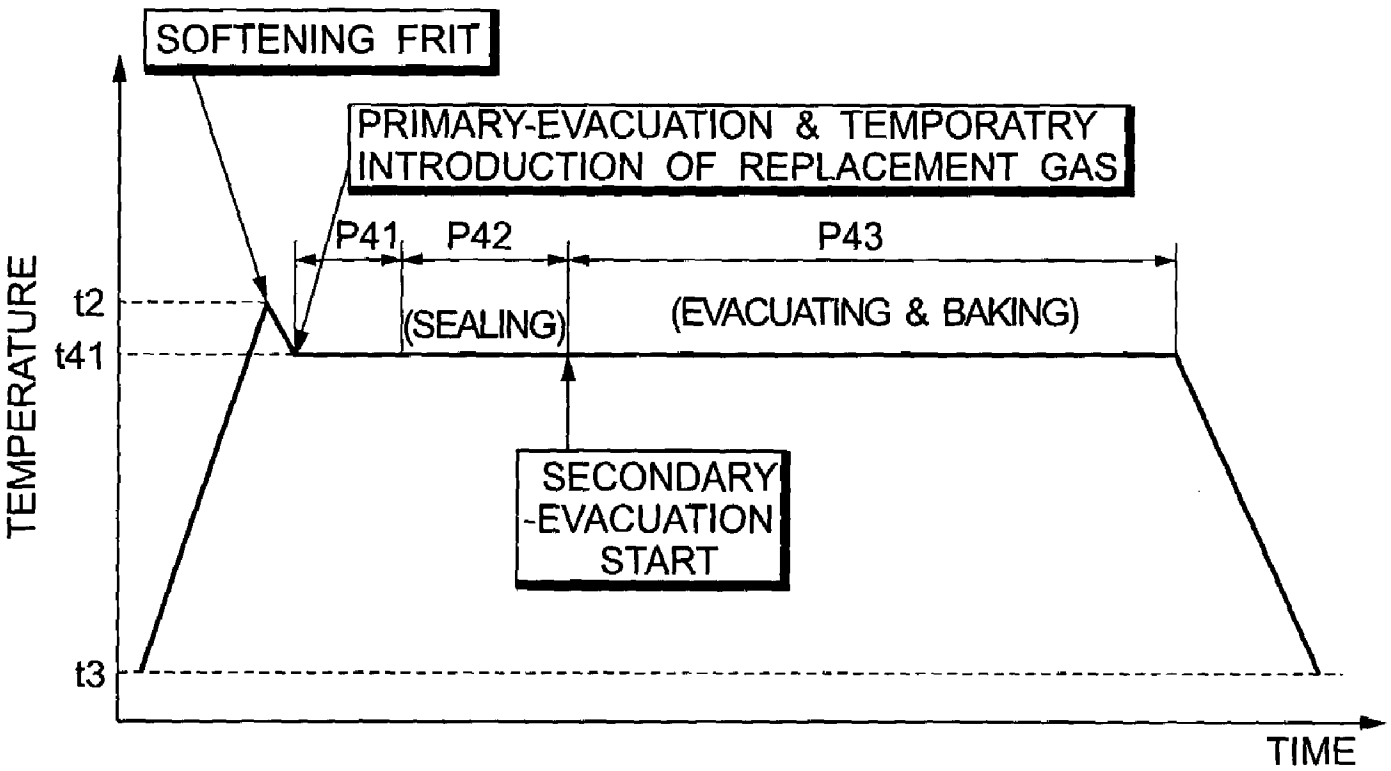
FIG. 11 is a graph illustrating a fourth embodiment of a method of manufacturing a display panel according to the present invention.

FIG. 11 is a graph showing the relationship between a change in temperature in the baking furnace and time elapsing in the process in a fourth embodiment of a method of manufacturing a display panel according to the present invention.

In the third embodiment, the temperature of the baking furnace H is raised to the sealing temperature t32 higher than the frit softening point temperature t2 after the expiration of the primary evacuation-replacement gas introduction period P31, and while the sealing temperature t32 is held, the sealing-process period P32 is established. However, in the fourth embodiment, both in a primary evacuation-replacement gas introduction period P41 and a sealing-process period P42, the temperature in the baking furnace H is retained at a temperature t41 (about 400 degree C.) lower than the frit softening point temperature t2.

Specifically, in the fourth embodiment, the temperature in the baking furnace H, in which the front substrate 1 and the back substrate 4 overlaying each other are placed, reaches the frit softening point temperature t2, and then is lowered to a temperature t41 lower than the frit softening point temperature t2. Then, the temperature 41 is retained throughout a predetermined primary evacuation-replacement gas introduction period P41, and the subsequent sealing process period P42 and the further subsequent evacuating-and-baking process period P43.

During the primary evacuation-replacement gas introduction period P41, the primary evacuation process S6 for driving the vacuum pump 11 to evacuate the discharge space S and the replacement gas introduction process S7 for introducing the replacement gas from the replacement gas introduction system 12 are performed (see FIGS. 4 and 6).

At this point, the temperature in the baking furnace H has reached the frit softening point temperature t2 before the primary evacuation process S6 and the replacement gas introduction process S7 are performed. Therefore, the softening surface of the sealing layer 7 comes in absolute contact with the front substrate 1 to hermetically seal the discharge space S. Accordingly, without atmosphere entering the discharge space S, the primary evacuation and the introduction of replacement gas are reliably performed.

After the completion of the primary evacuation-replacement gas introduction period P41, the sealing process S8 is performed in a sealing-process period P42. By this sealing process S8, the surface of the sealing layer 7, which melts when the temperature of the baking furnace H has reached the frit softening point temperature t2, is completely hermetically attached to the front substrate 1.

In an evacuating-and-baking process period P43 subsequent to the sealing-process period P42, the secondary evacuating-and-baking process S9 is performed.

Further, after the completion of the evacuating-and-baking process period P43, the temperature in the baking furnace H is lowered to near room temperature t3. Then, the discharge gas introduction process S10 is performed to introduce discharge gas from the discharge gas introduction system 13 into the discharge space S. Then, the sealing process S11 for sealing the discharge space S and the aging process S12 are performed.

Regarding the kinds of replacement gas introduced in the replacement gas introduction process, and the relationship between the concentration of the replacement gas and accelerating-voltage life of the PDP when oxygen gas is used as the replacement gas (FIG. 8), the fourth embodiment is the same as in the first embodiment.

Further, the relationship between the evacuation pressure in the primary evacuation process and voltage life of the PDP (FIG. 7) in the fourth embodiment is the same as that in the first embodiment.

With the method of manufacturing the display panel according to the fourth embodiment, prior to the sealing process S8 in the sealing-process period P42, the primary evacuation process S6 and the replacement gas introduction process S7 are performed. As a result of this procedure, the atmosphere filling the discharge space S and an impure gas produced from the substrates by heating are removed from the discharge space S. Thus, degassing from the protective layer (MgO layer) 3 is accelerated. Further, the inner surfaces of the substrates are prevented from being exposed to the impure gas, such as $H_2O$, $CO_2$ and the like, under high temperature conditions, which in turn prevents deterioration of the phosphor layer 6. As a result, it becomes possible to significantly improve panel performance (discharge properties) of the display panel.

In the fourth embodiment, when the temperature in the baking furnace H reaches the frit softening point temperature t2, the discharge space S between the front substrate 1 and the back substrate 4 is hermetically sealed. After that, the temperature in the baking furnace H is lowered. As a result, the flowing of the frit of the sealing layer 7 is inhibited, leading to a stable primary evacuation and stable introduction of the replacement gas.

Fifth Embodiment

Figure 12:
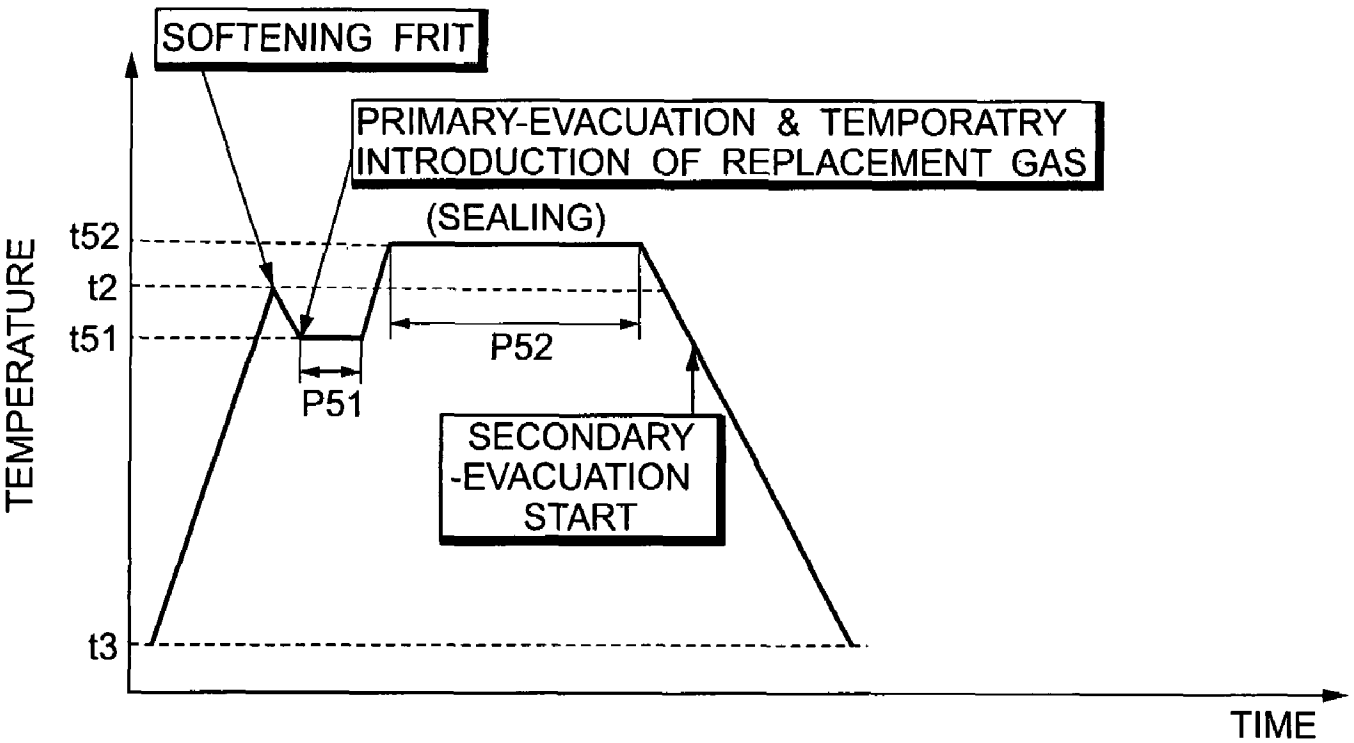
FIG. 12 is a graph illustrating a fifth embodiment of a method of manufacturing a display panel according to the present invention.

FIG. 12 is a graph showing the relationship between a change in temperature in the baking furnace and time elapsing in the process in a fifth embodiment of a method of manufacturing a PDP according to the present invention.

The third embodiment performs the secondary evacuating-and-baking process S9 in the evacuating-and-baking process period P33 under conditions in which the temperature in the baking furnace H is lowered to the temperature t31 (about 400 degree C.) lower than the frit softening point temperature t2 after the completion of the sealing process period P32 and then the temperature t31 is held. However, in the fifth embodiment, after the completion of a sealing-process period P52, the temperature in the baking furnace H is lowered. Then, while the temperature of the baking furnace H is being lowered, the secondary evacuation is performed after the temperature of the baking furnace H is lowered to the frit softening point temperature t2.

More specifically, after the temperature of the baking furnace H, in which the front substrate 1 and the back substrate 4 overlaying each other are placed, reaches the frit softening point temperature t2, the temperature of the baking furnace H is lowered to a temperature t51 (about 400 degree C.) lower than the frit softening point temperature t2. The temperature t51 is held during a predetermined primary exhaust-replacement gas introduction period P51.

During the primary evacuation-replacement gas introduction period P51, the primary evacuation process S6 for driving the vacuum pump 11 to evacuate the discharge space S and the replacement gas introduction process S7 for introducing the replacement gas from the replacement gas introduction system 12 are performed (see FIGS. 4 and 6).

At this point, the temperature in the baking furnace H has reached the frit softening point temperature t2 before the primary evacuation process S6 and the replacement gas introduction process S7 are performed. Therefore, the softening surface of the sealing layer 7 comes in absolute contact with the front substrate 1 to hermetically seal the discharge space S between the front substrate 1 and the back substrate 4. Accordingly, without atmosphere entering the discharge space S, the primary evacuation and the introduction of replacement gas are reliably performed.

After the completion of the primary evacuation-replacement gas introduction period P51, the temperature of the baking furnace H is raised to a sealing temperature t52 (about 450 degree C.) higher than the frit softening point temperature t2. The sealing temperature t52 is retained during a predetermined sealing process period P52. The sealing process S8 is performed in the sealing process period P52, so that the sealing layer 7 is completely hermetically attached to the front substrate 1.

After the completion of the sealing-process period P52, the temperature in the baking furnace H is lowered to about room temperature t3. During this decrease in furnace temperature, evacuation is started after the temperature in the baking furnace H approximately reaches the frit softening point temperature t2. This is the secondary evacuation process.

The fifth embodiment does not include the baking process.

After the temperature in the baking furnace H decreases to about room temperature t3, the discharge gas introduction process S10 is performed to introduce discharge gas from the discharge gas introduction system 13 into the discharge space S, and then, the sealing process S11 for sealing the discharge space S and the aging process S12 are performed.

Regarding the kinds of replacement gas introduced in the replacement gas introduction process, and the relationship between the concentration of the replacement gas and accelerating-voltage life of the PDP when oxygen gas is used as the replacement gas (FIG. 8), the fifth embodiment is the same as in the first embodiment.

Further, the relationship between the evacuation pressure in the primary evacuation process and voltage life of the PDP (FIG. 7) in the fifth embodiment is the same as that in the first embodiment.

With the method of manufacturing the PDP according to the fifth embodiment, prior to the sealing process S8 in the sealing-process period P52, the primary evacuation process S6 and the replacement gas introduction process S7 are performed. As a result of this procedure, the atmosphere filling the discharge space S and an impure gas produced from the substrates by heating are removed from the discharge space S. Thus, degassing from the protective layer (MgO layer) 3 is accelerated. Further, the inner surfaces of the substrates are prevented from being exposed to the impure gas, such as $H_2O$, $CO_2$ and the like, under high temperature conditions, which in turn prevents deterioration of the phosphor layer 6. As a result, it becomes possible to significantly improve panel performance (discharge properties) of the display panel.

The terms and description used herein are set forth by way of illustration only and are not meant as limitations. Those skilled in the art will recognize that numerous variations are possible within the spirit and scope of the invention as defined in the following claims.

What is claimed is:

1. A method of manufacturing a display panel in which a sealing material is placed in a position enclosing an internal space created between a pair of substrates spaced opposite to each other at a required distance, and the sealing material is heated to be softened at a predetermined temperature and fused to the substrates to seal the internal space between the pair of substrates, comprising:

a sealing process for sealing the internal space between the pair of substrates by use of the sealing material;

a primary evacuation process that is performed for evacuation of the internal space between the pair of substrates after a temperature for heating the sealing material reaches a starting temperature for softening the sealing material, and before the sealing process is performed; and an introduction process that is performed for introducing replacement gas into the internal space undergoing the primary evacuation process, after the temperature for heating the sealing material reaches the starting temperature for softening the sealing material, and before the sealing process is performed.

2. A method of manufacturing a display panel according to claim 1, wherein the primary evacuation process, the replacement gas introduction process and the sealing process are performed while the temperature for heating the sealing material is retained either at the starting temperature for softening the sealing material or at a temperature around and higher than the starting temperature for softening the sealing material.

3. A method of manufacturing a display panel according to claim 2, further comprising a secondary evacuation process that is performed for evacuating the internal space sealed between the pair of substrates while the temperature for heating the sealing material is retained at a predetermined temperature lower than the starting temperature for softening the sealing material, after the primary evacuation process, the replacement gas introduction process and the sealing process are performed.

4. A method of manufacturing a display panel according to claim 2, further comprising a secondary evacuation process that is performed for evacuating the internal space sealed between the pair of substrates while the temperature for heating the sealing material is retained at a temperature approximately equal to a temperature at which the primary evacuation process, the replacement gas introduction process and the sealing process are performed, after the primary evacuation process, the replacement gas introduction process and the sealing process have been performed.

5. A method of manufacturing a display panel according to claim 1, wherein the primary evacuation process and the replacement gas introduction process are performed after the temperature for heating the sealing material has reached the starting temperature for softening the sealing material, while the temperature for heating the sealing material is retained at a predetermined temperature lower than the starting temperature for softening the sealing material.

6. A method of manufacturing a display panel according to claim 5, whereinafter the primary evacuation process and the replacement gas introduction process have been performed, the sealing process is performed while the temperature for heating the sealing material is retained at a predetermined temperature higher than the starting temperature for softening the sealing material.

7. A method of manufacturing a display panel according to claim 6, further comprising a secondary evacuation process that is performed while the temperature for heating the sealing material is retained at a predetermined temperature lower than the starting temperature for softening the sealing material, after the sealing process has been performed.

8. A method of manufacturing a display panel according to claim 5, wherein after the primary evacuation process and the replacement gas introduction process have been performed, the sealing process is performed while the temperature for heating the sealing material is retained at a predetermined temperature lower than the starting temperature for softening the sealing material.

9. A method of manufacturing a display panel according to claim 8, further comprising a secondary evacuation process that is performed while the temperature for heating the sealing material is retained at a predetermined temperature lower than the starting temperature for softening the sealing material, after the sealing process has been performed.

10. A method of manufacturing a display panel according to claim 6, further comprising a secondary evacuation process that is performed after a decrease in the temperature of heating the sealing material has been started subsequent to the sealing process and then the decreasing temperature of heating the sealing material reaches a temperature lower than the starting temperature for softening the sealing material.

11. A method of manufacturing a display panel according to claim 1, wherein the replacement gas includes hydrogen gas.

12. A method of manufacturing a display panel according to claim 11, wherein a percentage of the hydrogen gas in the replacement gas is equal to or less than 3 percent.

13. A method of manufacturing a display panel according to claim 1, wherein the replacement gas includes oxygen gas.

14. A method of manufacturing a display panel according to claim 13, wherein a percentage of the oxygen gas in the replacement gas is equal to or less than 20 percent.

15. A method of manufacturing a display panel according to claim 1, wherein an evacuation pressure in the primary evacuation process is equal to or lower than $1\times10^{-2}$ Pascal.

16. A method of manufacturing a display panel according to claim 1, wherein in the replacement gas introduction process, the replacement gas of a 100 percent oxygen concentration is introduced.

* * * * *